US008468984B2

(12) United States Patent
Lee et al.

(10) Patent No.: US 8,468,984 B2
(45) Date of Patent: Jun. 25, 2013

(54) VARIABLE COMPRESSION RATIO APPARATUS

(75) Inventors: Ju Hun Lee, Gwangmyeong-si (KR); Dong Seok Lee, Suwon-si (KR); Jei Choon Yang, Yongin-si (KR); Eun Ho Lee, Hwaseong-si (KR); Byong Young Choi, Incheon-si (KR); Jin Kook Kong, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 302 days.

(21) Appl. No.: 12/957,209

(22) Filed: Nov. 30, 2010

(65) Prior Publication Data

US 2012/0012090 A1 Jan. 19, 2012

(30) Foreign Application Priority Data

Jul. 13, 2010 (KR) ..... 10-2010-0067412

(51) Int. Cl.
*F02B 75/04* (2006.01)

(52) U.S. Cl.
USPC ..... 123/78 BA; 123/78 B; 123/78 A

(58) Field of Classification Search
USPC ..... 123/78 BA, 78 R, 78 A, 78 D, 78 E, 123/48 R, 48 A, 48 B, 48 D
See application file for complete search history.

(56) References Cited

U.S. PATENT DOCUMENTS

| | | | | |
|---|---|---|---|---|
| 2,742,027 | A * | 4/1956 | Mausfield | 123/78 R |
| 5,136,987 | A * | 8/1992 | Schechter et al. | 123/48 B |
| 7,174,863 | B2 * | 2/2007 | Scalzo | 123/48 B |
| 7,574,986 | B2 * | 8/2009 | Ishikawa et al. | 123/78 BA |
| 2007/0175422 | A1 * | 8/2007 | Takahashi et al. | 123/78 BA |

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A variable compression ratio apparatus may include an external piston, a piston pin mounted in the external piston and a connecting rod, including an internal piston including a slot and sliding in an interior circumference of the external piston, wherein the piston pin passes through the internal piston and the external piston, a latching pin passing through the piston pin and selectively sliding therein, variable sliders disposed to selectively contact one of both ends of the latching pin, at both sides thereof to push the one of the both ends to the opposite side, and a support plate slidably supporting the variable sliders such that the variable sliders reciprocate perpendicular to length direction of the latching pin, wherein one end of a connecting arm selectively rotating may be connected to the variable slider and a sliding direction of the variable sliders may be controlled by rotation of the connecting arm.

17 Claims, 16 Drawing Sheets

(a) (b)

VARIABLE COMPRESSION RATIO APPARATUS

CROSS-REFERENCE TO RELATED APPLICATION

The present application claims priority to Korean Patent Application No. 10-2010-0067412 filed in the Korean Intellectual Property Office on Jul. 13, 2010, the entire contents of which is incorporated herein for all purposes by this reference.

BACKGROUND OF THE INVENTION

1. Field of the Invention

The present invention relates to a variable compression ratio apparatus. More particularly, the present invention relates to a variable compression ratio apparatus that changes compression ratio of gas mixture in a combustion chamber in accordance with operational conditions of an engine.

2. Description of Related Art

In general, thermal efficiency of heat engines increases when compression ratio is high and when igniting timing increases to a predetermined level in spark ignition engines. However, the spark ignition engines have a limit in increasing the ignition timing because the engines may be damaged by abnormal combustion when the ignition timing is increased at high compression ratio, which necessarily reduce the output power.

A variable compression ratio (VCR) apparatus is an apparatus that changes compression ratio of gas mixture in accordance with operational conditions of the engine. According to the compression ratio apparatus, fuel efficiency is improved by increasing the compression ratio of gas mixture under the low load condition of the engine, and knocking is prevented and the engine output is improved by reducing the compression ratio of the gas mixture under the high load condition of the engine.

In order to achieve the variable compression ratio, an oil chamber is formed inside a bias ring disposed in a small portion of a connecting rod and the bias ring is eccentrically rotated by hydraulic pressure generated by supplying oil into the oil chamber, which has been proposed; however, the variable compression ratio apparatus according to the related art has a problem that the distance from the bias ring to the center of the oil chamber is small, such that pressure for maintaining the position of the bias ring in the oil chamber is largely increased when explosion pressure is applied, and it is difficult to maintain the compression ratio.

Further, there is a problem requiring excessive oil pressure, which is needed to change the compression ratio.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus having advantages of having an improved structure to efficiently change compression ratio in a cylinder.

In an aspect of the present invention, the variable compression ratio apparatus including an external piston, a piston pin mounted in the external piston, a crankshaft, and a connecting rod pivotally connecting the external piston with the crankshaft, may include an internal piston including a slot and sliding up or down in close contact to an interior circumference of the external piston, wherein the piston pin passes through the slot of the internal piston and the external piston, a latching pin passing through the piston pin and selectively sliding therein, variable sliders disposed to selectively contact one of both ends of the latching pin, at both sides thereof to push the one of the both ends to the opposite side, and a support plate slidably supporting the variable sliders such that the variable sliders reciprocate in perpendicular direction to the length direction of the latching pin, wherein one end of a connecting arm selectively rotating may be connected to the variable slider and a sliding direction of the variable sliders may be controlled by rotation of the connecting arm.

An oil chamber may be formed between the inside of the external piston and the top of the internal piston so as to selectively store oil therein to generate hydraulic pressure, wherein an oil supply channel may be formed in the connecting rod to supply oil to the oil chamber.

A control channel may be formed in the latching pin to receive oil from the oil supply channel formed in the connecting rod and oil in the control channel may be selectively supplied into the oil chamber by reciprocation of the latching pin.

Protrusions may be formed on an inner side of the variable sliders to correspond to the both ends of the latching pin, and the protrusions do not face each other in movement direction therebetween.

The rotary shaft and the variable slider may be connected by the connecting arm, wherein an adaptor integrally rotating with the rotary shaft may be mounted on an external circumferential surface of the rotary shaft, the rotary shaft and the connecting arm may be connected by a first hinge portion of the adaptor, and the connecting arm may be connected with the variable slider by a second hinge portion, such that as the rotary shaft selectively rotates in one direction, the connecting arm reciprocates straight by means of the first hinge portion and the second hinge portion.

A guide rail that guides the variable sliders reciprocating forward/backward may be formed on one side of a fixing block wherein the fixing block fixes the support plate and slidably supports the variable sliders.

The rotary shaft may be operated by a separate vacuum actuator.

An oil supply line may be formed on one side in the internal piston and an oil discharge line may be formed on the other side thereof, wherein an oil discharge hole may be formed through the other side of the internal piston to communicate with an oil chamber through the oil discharge line.

An oil supply hole may be formed through the one side of the internal piston to selectively communicate with a control channel of the latching pin, wherein a first check valve may be disposed in the oil supply line to selectively connect the control channel of the latching pin to the oil chamber and a second check valves may be disposed in the oil discharge line to selectively discharge the oil from the oil chamber to the outside, wherein a sliding pin may be disposed in the oil supply line to slide therein to open the oil supply line such that the control channel fluid-communicates with the oil chamber, when oil may be supplied to a side of the sliding pin.

An elastic member may be disposed at one end of the sliding pin to elastically support the end such that the oil supply line may be closed by the elastic member, when oil may be not supplied to the side of the sliding pin.

Locking protrusions formed to the sliding pin protrude from an external circumferential surface thereof in perpendicular direction to a motion direction of the sliding pin and integrally moves by a motion of the sliding pin, wherein an operational groove may be formed on the external circumferential surface of the internal piston and the locking protrusions protrude through operational holes formed through the operational groove.

A plurality of support protrusions may be formed downwards on the operation grooves in the internal piston and an operational ring having protrusions corresponding to the support protrusions on the interior circumference thereof may be inserted in the operation grooves, wherein the locking protrusions of the sliding pin and the protrusions of the operational ring may be engaged such that, as the sliding pin reciprocates, the operational ring selectively rotates in both directions by the protrusions of the sliding pin and the protrusions of the operational ring may be selectively engaged with the support protrusions in accordance with reciprocating direction of the operational ring.

According to the exemplary embodiment of the present invention, since hydraulic pressure may be selectively released or supplied through the oil chamber formed between the external piston and the internal piston, such that it may be possible to achieve a stable and efficient variable compression ratio.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
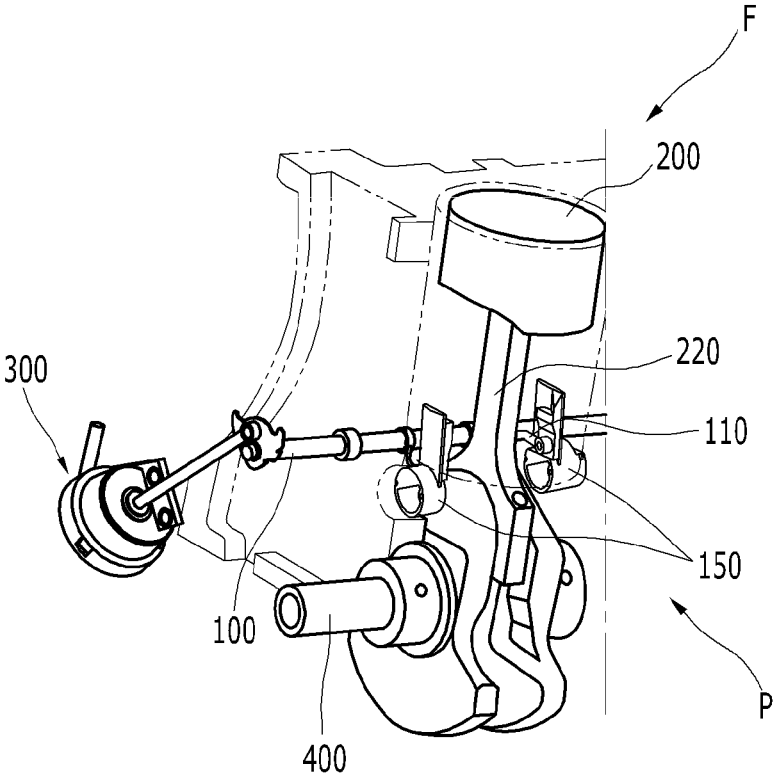
FIG. 1 is a perspective view showing a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a perspective view showing a variable compression ratio apparatus according to an exemplary embodiment of the present invention.

Figure 2:
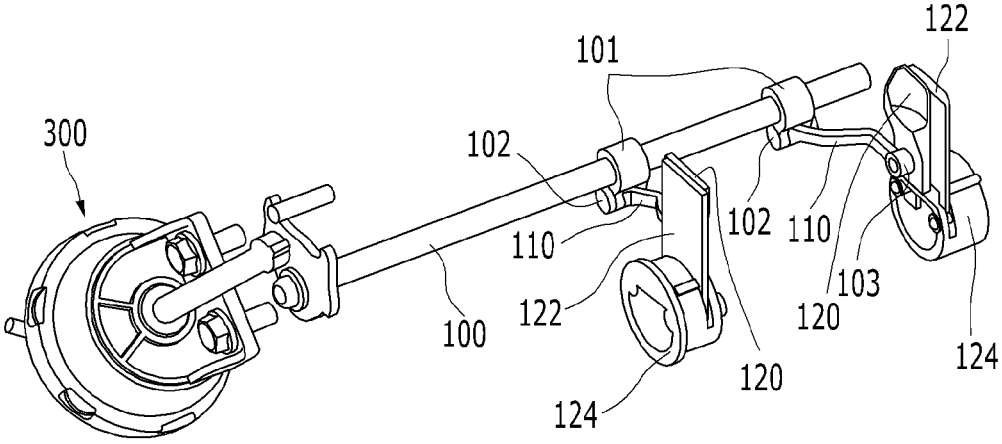
FIG. 2 is a perspective view showing a driving part of the variable compression ratio apparatus according to an exemplary embodiment of the present invention.

FIG. 2 is a perspective view showing a driving part of the variable compression ratio apparatus according to an exemplary embodiment of the present invention.

Figure 3:
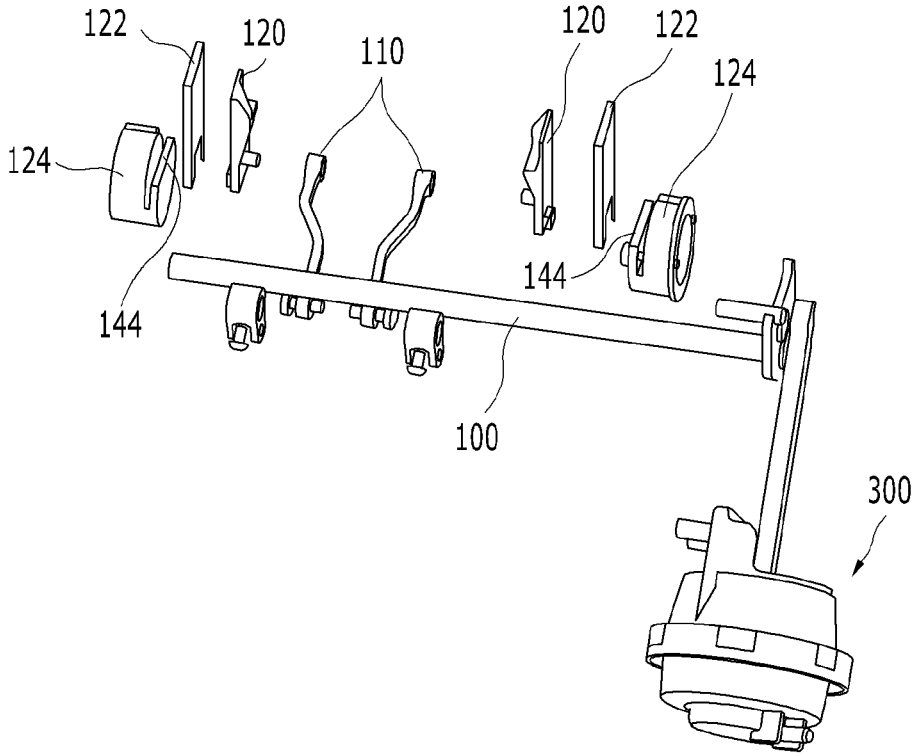
FIG. 3 is an exploded perspective view of FIG. 2.

FIG. 3 is an exploded perspective view of FIG. 2.

Figure 4:
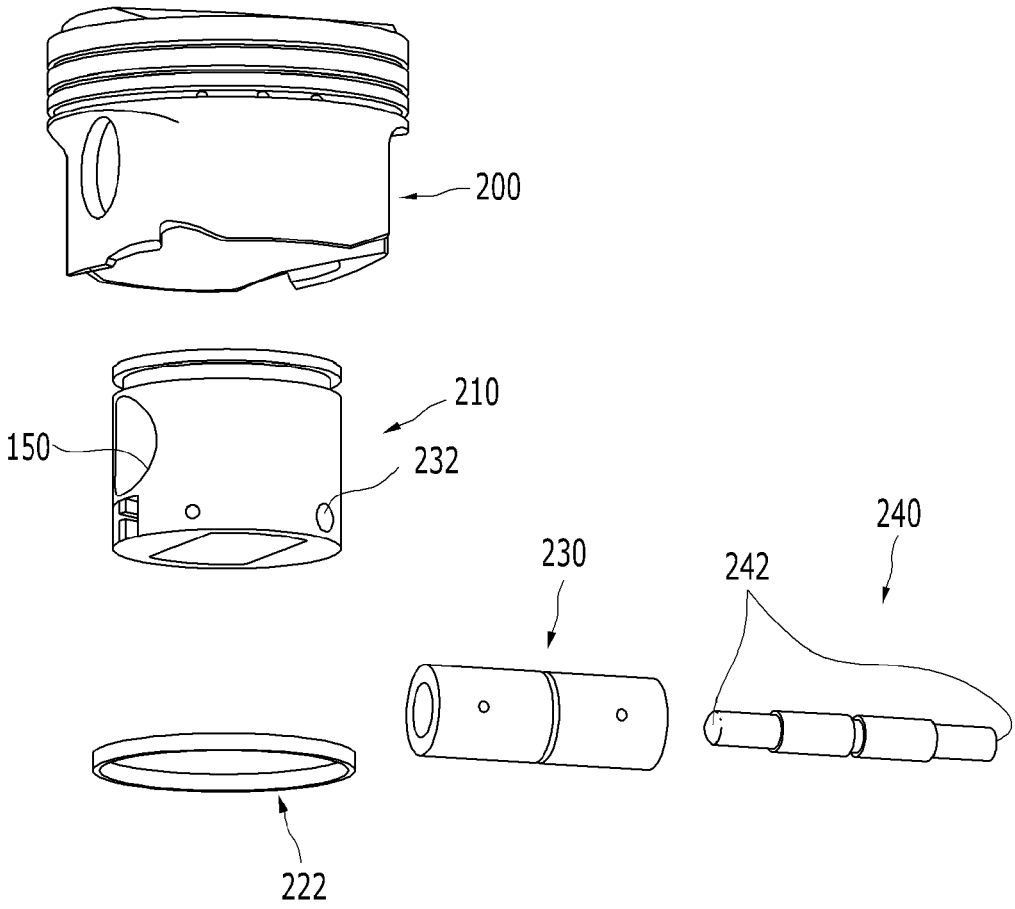
FIG. 4 is an exploded perspective view showing an operation unit of the variable compression ratio apparatus according to an exemplary embodiment of the present invention.

FIG. 4 is an exploded perspective view showing an operation unit of the variable compression ratio apparatus according to an exemplary embodiment of the present invention.

Figure 5:
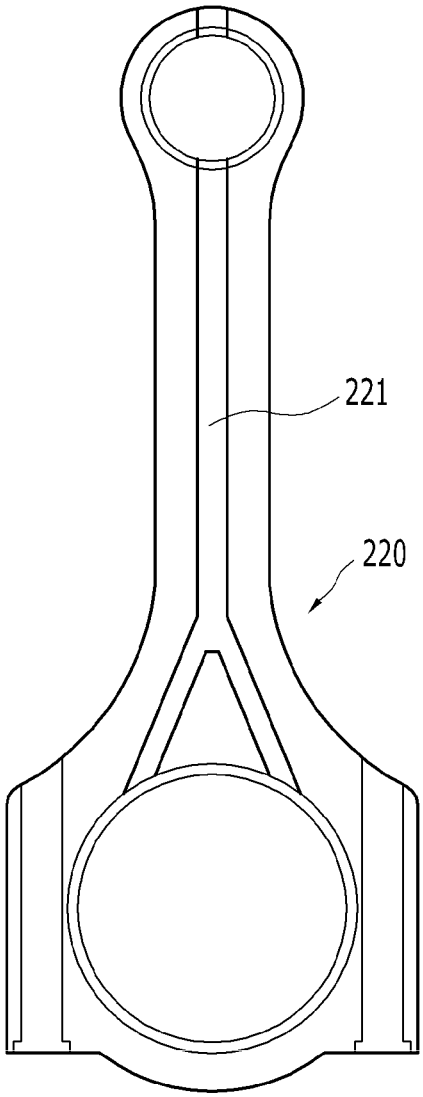
FIG. 5 is a cross-sectional view showing a connecting rod used in the variable compression ratio apparatus according to an exemplary embodiment of the present invention.

FIG. 5 is a cross-sectional view showing a connecting rod used in the variable compression ratio apparatus according to an exemplary embodiment of the present invention.

Figure 6:
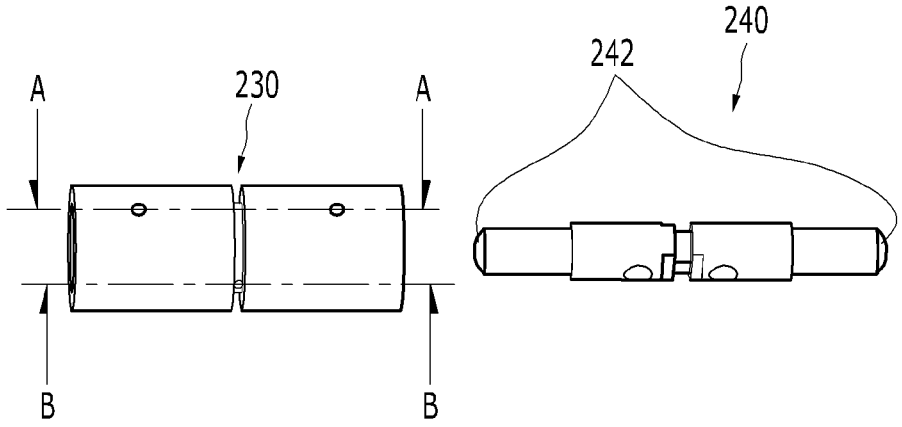
FIG. 6 is a perspective view showing a piston pin used in the variable compression ratio apparatus according to an exemplary embodiment of the present invention.

FIG. 6 is a perspective view showing a piston pin used in the variable compression ratio apparatus according to an exemplary embodiment of the present invention.

Figure 7:
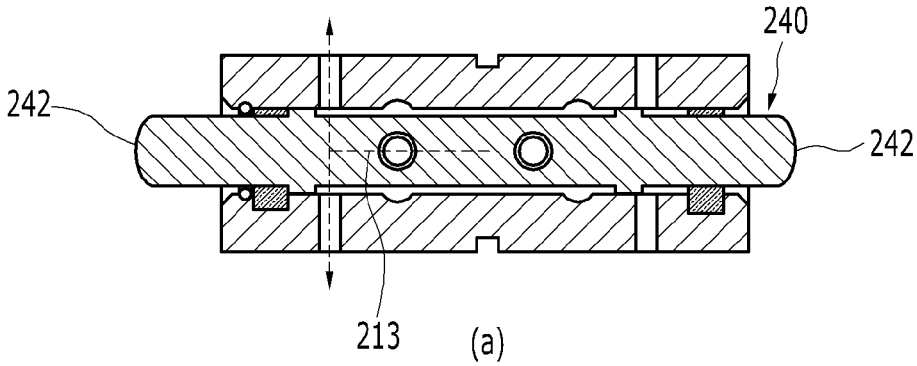
FIG. 7 is a cross-sectional view showing when a latching pin has moved to one side from the combination position shown in FIG. 6.
Figure 7:
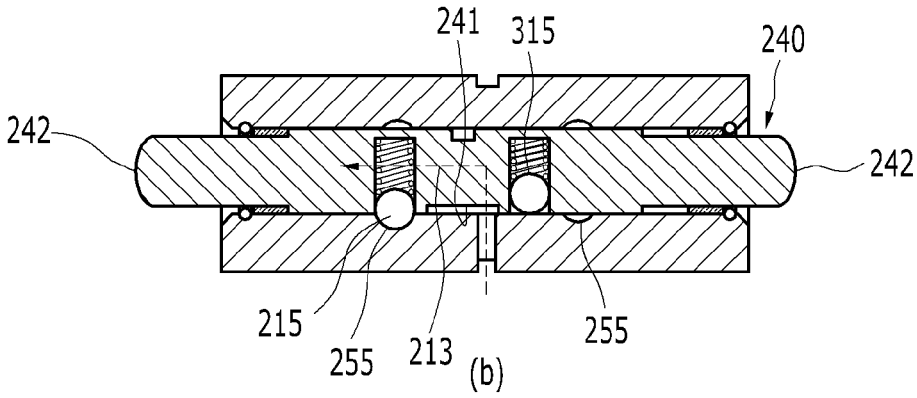

FIG. 7 is a cross-sectional view showing when a latching pin has moved to one side from the combination position shown in FIG. 6.

Figure 8:
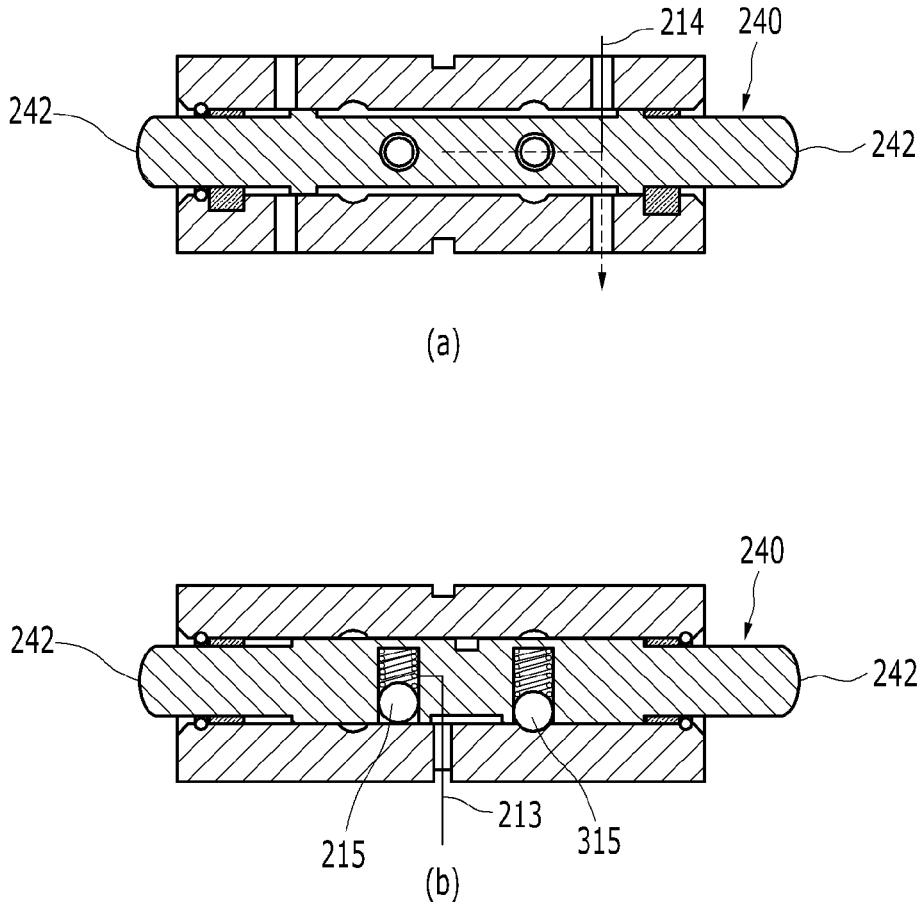
FIG. 8 is a cross-sectional view when the latching pin has moved to the other side from the combination position shown in FIG. 6.

FIG. 8 is a cross-sectional view when the latching pin has moved to the other side from the combination position shown in FIG. 6.

Figure 9:
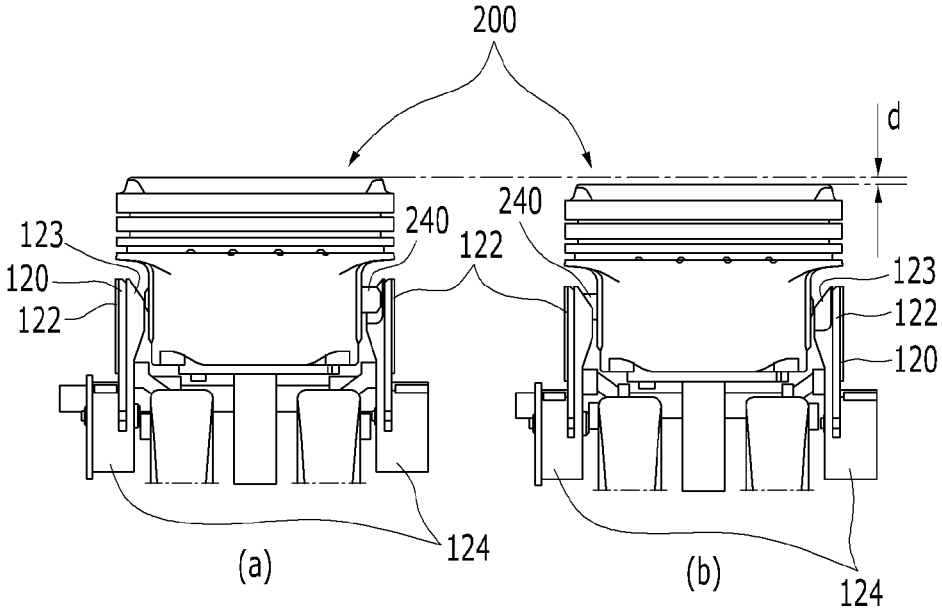
FIG. 9 is a view when the operation unit of the variable compression ratio apparatus according to an exemplary embodiment of the present invention operates at a high compression ratio and a low compression ratio.

FIG. 9 is a view when the operation unit of the variable compression ratio apparatus according to an exemplary embodiment of the present invention operates at a high compression ratio and a low compression ratio.

Figure 10:
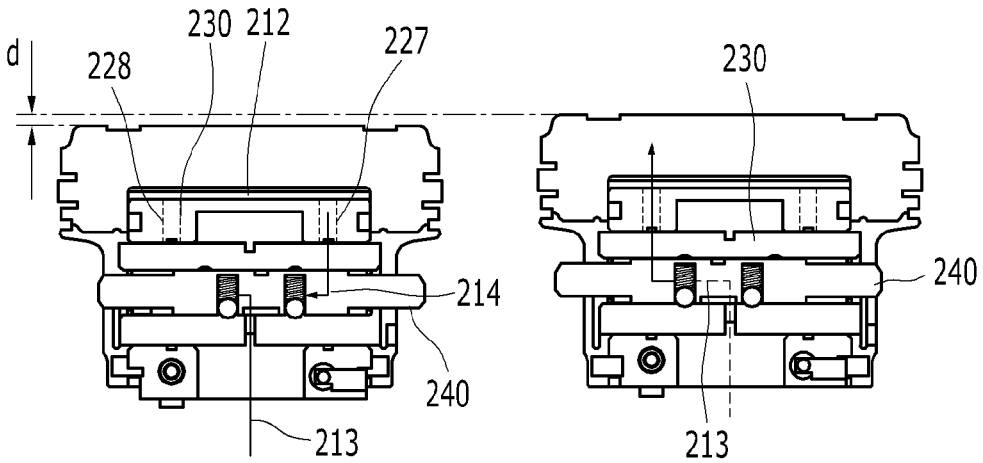
FIG. 10 is a cross-sectional view when the operation unit of FIG. 9 is at a high compression ratio and a low compression ratio.

FIG. 10 is a cross-sectional view when the operation unit of FIG. 9 is at a high compression ratio and a low compression ratio.

Figure 11:
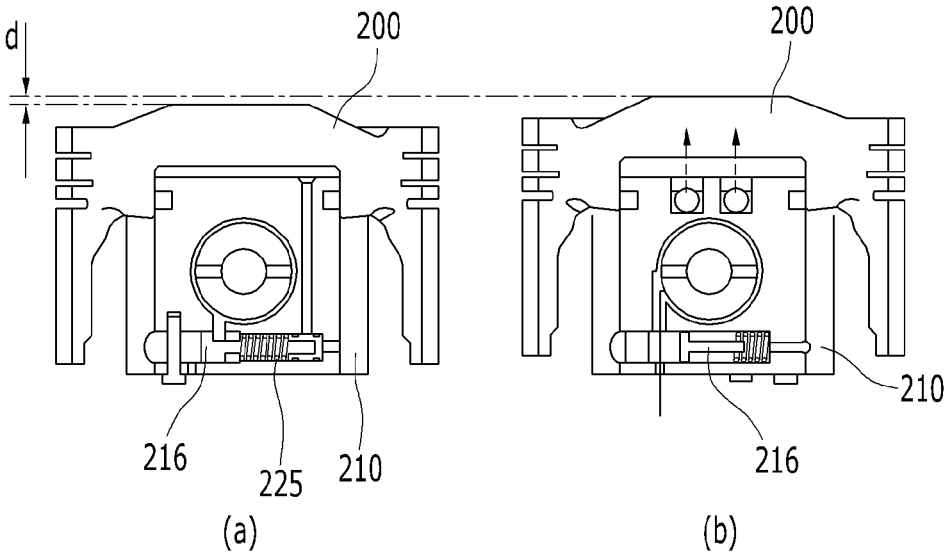
FIG. 11 is a cross-sectional view showing a sliding pin at a high compression ratio and a low compression ratio.

FIG. 11 is a sliding pin at a high compression ratio and a low compression ratio.

Figure 12:
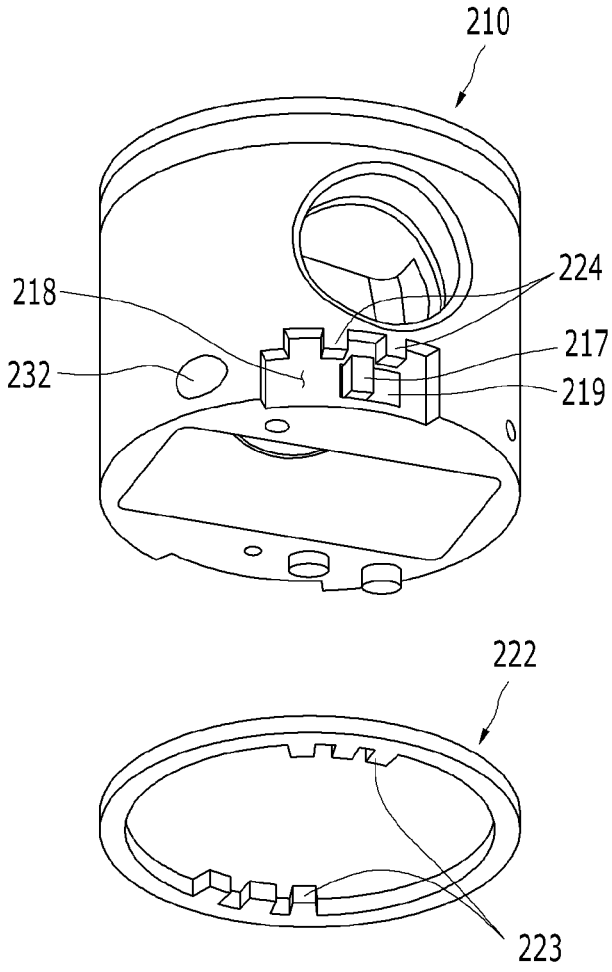
FIG. 12 is a perspective view showing a piston used in the variable compression ratio apparatus according to an exemplary embodiment of the present invention.

FIG. 12 is a perspective view showing a piston used in the variable compression ratio apparatus according to an exemplary embodiment of the present invention.

Figure 13:
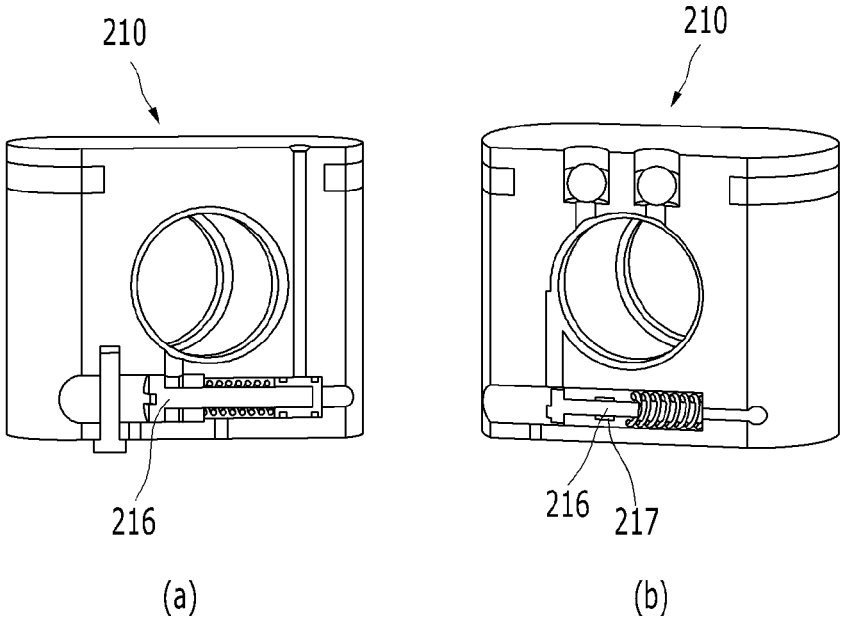
FIG. 13 is a cross-sectional view showing the front and rear sides of the piston used in the variable compression ratio apparatus according to an exemplary embodiment of the present invention.

FIG. 13 is a cross-sectional view showing the front and rear sides of the piston used in the variable compression ratio apparatus according to an exemplary embodiment of the present invention.

Figure 14:
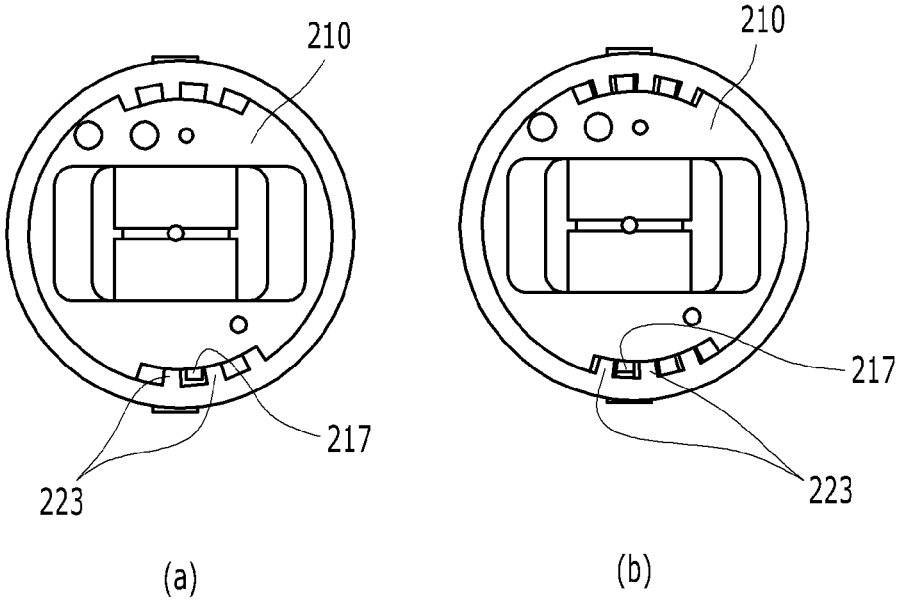
FIG. 14 is a horizontal cross-sectional view showing the piston used in the variable compression ratio apparatus according to an exemplary embodiment of the present invention.

FIG. 14 is a horizontal cross-sectional view showing the piston used in the variable compression ratio apparatus according to an exemplary embodiment of the present invention.

Figure 15:
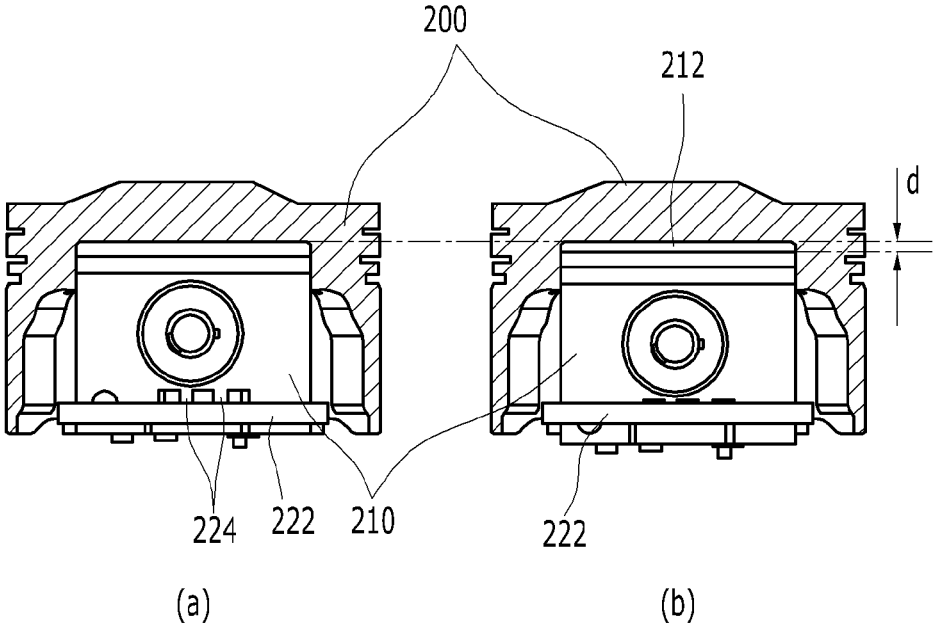
FIG. 15 is a front view of FIG. 14.

FIG. 15 is a front view of FIG. 14.

Figure 16:
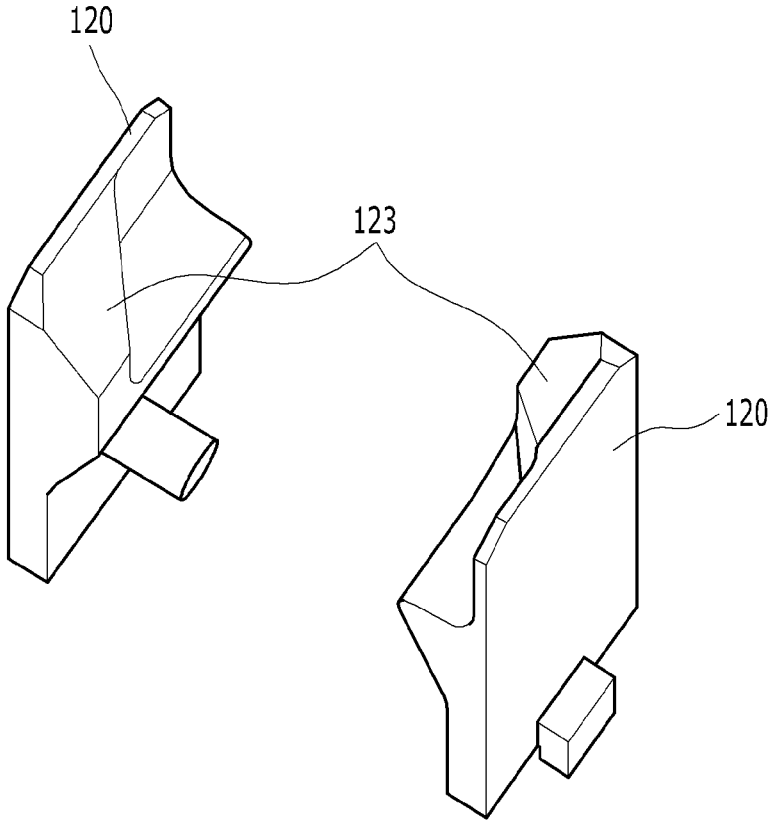
FIG. 16 is a perspective view showing a variable slider used in the variable compression ratio apparatus according to an exemplary embodiment of the present invention.

FIG. 16 is a perspective view showing a variable slider used in the variable compression ratio apparatus according to an exemplary embodiment of the present invention.

Referring to FIG. 1 to FIG. 4, a variable compression ratio apparatus according to the exemplary embodiment of the present invention includes a driving part P composed of a rotary shaft 100, a connecting arm 110, and a variable slider 120, and an operation unit F composed of an external piton 200 reciprocating by means of explosion of fuel in a cylinder of an engine and an internal piston 210 sliding in the external piston 200, wherein the internal piston 210 includes a slot 150 and the piston pin 230 passes through the slot 150. The slot 150 is larger than the diameter of a piston pin 230 to allow a sliding motion of the internal piston 210 in the external piston 200.

The rotary shaft 100 is selectively rotated in both directions by an actuator 300 separately disposed outside a cylinder block (not provided with reference numeral).

The actuator 300 may be any device that can operate the rotary shaft 100, such as a vacuum actuator.

In this configuration, the external piston 200 mounted in the cylinder block is disposed to reciprocate along the inner wall of the cylinder and operated by a crankshaft 400 operating with the external piston 200, and the external piston 200 and the connecting rod 220 are connected by the piston pin 230 at the upper end of the connecting rod 220.

Further, a latching pin 240 vertically reciprocating in the piston pin 230 is provided.

Further, a space is defined between the external piston 200 and the internal piston 210.

That is, the internal piston 210 is disposed to vertically reciprocate in close contact to the inner circumference of the external piston 200 and an oil chamber 212 temporarily storing oil and generating pressure is formed in the space that is defined when the internal piston 210 moves down.

Referring to FIG. 5, a separate oil supply channel 221 may be formed in the connecting rod 220 to supply oil into the oil chamber 212 through a control channel 242 of the latching pin 240.

That is, the oil supplied through the oil supply channel 221 selectively communicates with the oil chamber 212 by selectively opening the control channel 241 of the latching pin 240, in accordance with reciprocation of the latching pin 240, as explained hereinafter.

That is, as shown in FIG. 7 and FIG. 8, the control channel 241 is formed in the latching pin 240, communicates with the oil supply channel 221 and selectively communicates with the oil chamber 212 in accordance with left-right reciprocation of the latching pin 240, such that the oil flows into the oil chamber 212.

The latching pin 240 includes check valves 215 and 315 and inner surface of the piston pin 230 includes locking grooves 255 such that check valves 215 and 315 are selectively open by being alternatively engaged into the locking grooves 255 in accordance with left-right reciprocation of the latching pin 240.

In FIG. 7, the check valve 215 is configured to control an oil flow of oil supply line 213 such that when the latching pin 240 moves in the left direction, a ball of the check valve 215 is locked to the locking groove 255 and thus the oil supply line 213 opens to supply oil to the oil chamber 212 through oil supply hole 228 formed in the internal piston 210.

In contrast, in FIG. 8, the check valve 315 is configured to control an oil flow of oil discharge line 214 such that when the latching pin 240 moves in the right direction, a ball of the check valve 315 is locked to the locking groove 255 and thus the oil discharge line 214 opens to discharge oil from the oil chamber 212 through oil discharge hole 227 formed in the internal piston 210.

In this operation, the rotary shaft 100 is rotated about the axis by the separate actuator 300. The actuator 300 may be a vacuum actuator, as described above.

Referring to FIG. 2 and FIG. 3, two adaptors 101 may be attached to the outer circumferential surface of the rotary shaft 100.

The pair of adaptors 101 connects a pair of connecting arms 110 with a pair of variable sliders 120 to integrally operate in accordance with rotation of the rotary shaft 100.

A first hinge portion 102 is formed at one end of each of the adaptors 101.

The adaptor 101 and the rotary shaft 100 are connected by the first hinge portion 102, and the connecting arm 110 and the variable slider 120 are connected by a second hinge portion 103 formed at the other ends of the connecting arms 110.

That is, as the rotary shaft 100 is rotated by the actuator 300, the connecting arm 110 rotated by the first hinge portion 102 of the adaptor 101 reciprocates straight.

Therefore, the variable slider 120 hinged to the second hinge portion 103 of the connecting arm 110 also reciprocates straight.

In this configuration, the variable slider 120 has a support plate 122 with a guide rail, which assists straight motion, on the outer side.

Further, as shown in FIG. 16, protrusions 123 are formed on the opposite inner sides of the variable slider 120.

The protrusions 123 is disposed to correspond to both ends of the latching pin 240.

Further, both protrusions 123 are positioned without overlapping each other in the front-rear direction.

That is, when both variable sliders 120 are on the same vertical line, opposite to each other, the protrusions 123 are not positioned on the same vertical line, such that as the variable sliders 120 selectively moves forward and backward, the protrusion 123 of any one of the variable sliders 120 presses any one end 242 of the latching pin 240.

The support plate 122 may have a plate shape that is wide such that ensure a movement distance while guiding the variable slider 120 moving straight along the guide rail.

Further, a fixing block 124 is formed at the lower portion of the support plate 122 to slidably support the variable slider 120 and to fix the support plate 122.

The fixing block 124 is provided to firmly fix the variable slider 120 and the support plate 122 in the cylinder block, using a connecting member.

The fixing block 124 includes a guide rail 144 such that the variable slider 120 slides thereon.

Referring to FIG. 9 to FIG. 12, oil flow at a high compression ratio and a low compression ratio in the variable compression ratio apparatus according to the exemplary embodiment of the present invention can be seen.

FIG. 10A and FIG. 12 A show a low compression ratio, where the oil discharge line 214 formed in the internal piston 210 is opened by the check valve 315 and the oil supply line 213 is closed by the check valve 214 by right motion of the latching pin 240.

That is, since the check valve 315 in the oil discharge line 214 of the internal piston 210 is opened and the check valve 215 in the oil supply line 213 is closed, the oil in the oil chamber 212 is discharged through a discharge hole 232 formed through one side of the internal piston 210.

In an exemplary embodiment of the present invention, a sliding pin 216 is slidably disposed in the oil supply line 213 and elastically biased by an elastic member 225. Accordingly, in the low compression ratio, the sliding pin 216 in the oil supply line 213 is moved in the left direction by the elastic member 225 since hydraulic pressure is not supplied in the oil supply line 213.

Simultaneously, the hydraulic pressure generated in the oil chamber 212 is removed, such that the external piston 200 moves down.

FIG. 10B and FIG. 11B show a high compression ratio, where the oil supply line 213 formed in the internal piston 210 is open by the latching pin 240.

That is, while the oil is supplied from the oil supply line 213 of the internal piston 210, the oil discharge line 214 at the other side is closed by the check valve 315, such that hydraulic pressure is generated in the oil chamber 212.

In an exemplary embodiment of the present invention, a sliding pin 216 is slidably disposed in the oil supply line 213 and elastically biased by an elastic member 225. Accordingly, in the high compression ratio, the sliding pin 216 in the oil supply line 213 is moved in the right direction while hydraulic pressure is supplied in the oil supply line 213 as shown in FIG. 11B.

Further, as shown in FIG. 14 and FIG. 15, an operational protrusion 217 formed to the sliding pin 216 protrudes vertically outward with the motion direction of the sliding pin from the external circumferential surface, surrounding the external circumferential surface of the sliding pin 216.

Further, an operational groove 218 is formed on the external circumferential surface of the internal piston 210.

The operational groove 218 has an operational hole 219 formed radially outward through the groove.

In this configuration, the operational protrusion 217 protrudes outside the internal piston 210 through the operational hole 219 and operates with a plurality of locking protrusions 223 formed on the inner circumference of an operational ring 222, which is described below.

The operational ring 222 is fitted on the external circumferential surface of the internal piston 210.

Since the operational ring 222 has a ring shape and has the locking protrusions 223 substantially symmetric at both sides, on the interior circumference, as described above.

The locking protrusions 223 selectively rotate in both directions by engaging with each other in accordance with reciprocation of the operational protrusion 217 of the sliding pin 216.

In this configuration, a support protrusion 224 protruding downward is formed above the operational groove 218.

That is, as shown in FIG. 16, as the operational ring 222 is rotated by the operational protrusion 217 of the sliding pin 216, the locking protrusions 223 of the operational ring 222 are selectively supported by the support protrusions 224 of the operational groove 218, or engaged with each other in the up-down direction. Therefore, the height changes by the distance 'd', such that the compression ratio changes.

According to the variable compression ratio apparatus according to the exemplary embodiment of the present invention, it is possible to stably carry combustion load at a high compression ratio in comparison to the structures of the related art, such that is it possible to stably achieve a compression ratio.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A variable compression ratio apparatus including an external piston, a piston pin mounted in the external piston, a crankshaft, and a connecting rod pivotally connecting the external piston with the crankshaft, the apparatus comprising:

an internal piston including a slot and sliding up or down in close contact to an interior circumference of the external piston, wherein the piston pin passes through the slot of the internal piston and the external piston;

a latching pin passing through the piston pin and selectively sliding therein;

variable sliders disposed to selectively contact one of both ends of the latching pin, at both sides thereof to push the one of the both ends to the opposite side; and a support plate slidably supporting the variable sliders such that the variable sliders reciprocate in perpendicular direction to the length direction of the latching pin;

wherein one end of a connecting arm selectively rotating is connected to the variable slider and a sliding direction of the variable sliders is controlled by rotation of the connecting arm;

wherein an oil chamber is formed between the inside of the external piston and the top of the internal piston so as to selectively store oil therein to generate hydraulic pressure; and wherein a control channel is formed in the latching pin to receive oil from the oil supply channel formed in the connecting rod and oil in the control channel is selectively supplied into the oil chamber by reciprocation of the latching pin.

2. The apparatus of claim 1, wherein an oil supply channel is formed in the connecting rod to supply oil to the oil chamber.

3. The apparatus of claim 1, wherein protrusions are formed on an inner side of the variable sliders to correspond to the both ends of the latching pin, and the protrusions do not face each other in movement direction therebetween.

4. The apparatus of claim 1, wherein the rotary shaft and the variable slider are connected by the connecting arm.

5. The apparatus of claim 4, wherein an adaptor integrally rotating with the rotary shaft is mounted on an external circumferential surface of the rotary shaft, the rotary shaft and the connecting arm are connected by a first hinge portion of the adaptor, and the connecting arm is connected with the variable slider by a second hinge portion, such that as the rotary shaft selectively rotates in one direction, the connecting arm reciprocates straight by means of the first hinge portion and the second hinge portion.

6. The apparatus of claim 1, wherein a guide rail that guides the variable sliders reciprocating forward/backward is formed on one side of a fixing block wherein the fixing block fixes the support plate and slidably supports the variable sliders.

7. The apparatus of claim 1, wherein the rotary shaft is operated by a separate vacuum actuator.

8. The apparatus of claim 1, wherein an oil supply line is formed on one side in the internal piston and an oil discharge line is formed on the other side thereof.

9. The apparatus of claim 8, wherein an oil discharge hole is formed through the other side of the internal piston to communicate with an oil chamber through the oil discharge line.

10. The apparatus of claim 9, wherein an oil supply hole is formed through the one side of the internal piston to selectively communicate with a control channel of the latching pin.

11. The apparatus of claim 10, wherein a first check valve is disposed in the oil supply line to selectively connect the control channel of the latching pin to the oil chamber and a second check valves is disposed in the oil discharge line to selectively discharge the oil from the oil chamber to the outside.

12. The apparatus of claim 11, wherein a sliding pin is disposed in the oil supply line to slide therein to open the oil supply line such that the control channel fluid-communicates with the oil chamber, when oil is supplied to a side of the sliding pin.

13. The apparatus of claim 12, wherein an elastic member is disposed at one end of the sliding pin to elastically support the end such that the oil supply line is closed by the elastic member, when oil is not supplied to the side of the sliding pin.

14. The apparatus of claim 12, wherein locking protrusions formed to the sliding pin protrude from an external circumferential surface thereof in perpendicular direction to a motion direction of the sliding pin and integrally moves by a motion of the sliding pin.

15. The apparatus of claim 14, wherein an operational groove is formed on the external circumferential surface of the internal piston and the locking protrusions protrude through operational holes formed through the operational groove.

16. The apparatus of claim 15, wherein a plurality of support protrusions are formed downwards on the operation grooves in the internal piston and an operational ring having protrusions corresponding to the support protrusions on the interior circumference thereof are inserted in the operation grooves.

17. The apparatus of claim 16, wherein the locking protrusions of the sliding pin and the protrusions of the operational ring are engaged such that, as the sliding pin reciprocates, the operational ring selectively rotates in both directions by the protrusions of the sliding pin and the protrusions of the operational ring are selectively engaged with the support protrusions in accordance with reciprocating direction of the operational ring.

* * * * *